United States Patent [19]

Fales et al.

[11] 4,189,051

[45] Feb. 19, 1980

[54] LAMP PACKAGING

[76] Inventors: Gene T. Fales; Dennis V. Dollar, both c/o Dunning Industries, Inc., P.O. Box 11393, Greensboro, N.C. 27409

[21] Appl. No.: 941,574

[22] Filed: Sep. 12, 1978

[51] Int. Cl.[2] ..... B65D 85/00

[52] U.S. Cl. ..... 206/326; 206/495; 206/497

[58] Field of Search ..... 206/326, 334, 460, 462, 206/486, 495, 497, 500, 573

[56] References Cited

U.S. PATENT DOCUMENTS

| | | | |
|---|---|---|---|
| 1,640,452 | 8/1927 | Knowlton | 206/500 |
| 1,921,724 | 8/1933 | Bohuke | 206/326 |
| 1,934,566 | 11/1933 | Salomon | 206/326 |
| 2,377,603 | 6/1945 | Belden | 206/486 |
| 2,622,732 | 12/1952 | Panzer | 206/326 |
| 3,142,446 | 7/1964 | Okamato | 206/326 |
| 3,198,321 | 8/1965 | Palitano | 206/573 |
| 3,406,814 | 10/1968 | Gulliver | 206/497 |
| 4,030,603 | 6/1977 | Angell | 206/497 |

*Primary Examiner*—Herbert F. Ross
*Attorney, Agent, or Firm*—Cushman, Darby & Cushman

[57] ABSTRACT

An article containing carton, and method of assembling it, for packaging a lamp and lamp shade in the same carton in a minimum of space and with little chance that the lamp and lamp shade will be damaged during transport. The lamp is attached to a first support panel with heat shrinkable material, and the lamp shade is attached between second and third support panels with heat shrinkable material surrounding the support panels and the shade. The first support panel is operatively fastened to the bottom of the carton, and the assembly of the lamp shade and second and third support panels, wrapped by heat shrinkable material, is positioned within the carton so that the lamp and shade are always maintained in spaced relationship in the carton horizontal dimensions, and so that the lamp does not abut the shade supporting spider. The third panel has a central opening through which a portion of the lamp extends into the interior volume defined by the shade. A detachable harp from the lamp may be disposed between the second support panel and the heat shrinkable material, and impact absorbing pads may be disposed between the supporting spider and the second support panel.

13 Claims, 2 Drawing Figures

LAMP PACKAGING

BACKGROUND AND SUMMARY OF THE INVENTION

The invention relates to a carton, and method of assembly thereof, for packaging a lamp and a lamp shade. There are numerous proposals in the prior art for the packaging of lamps for transportation. For instance, U.S. Pat. Nos. 1,934,566; 3,158,261; and 4,030,603 provide cartons for packaging lamps without the shades. U.S. Pat. No. 3,142,446 suggests the packaging of a lamp and shade in the same carton, the lamp and shade being unconnected so that the impact forces transmitted to the package do not result in damage to the lamp or shade. In order to provide packaging of the lamp and shade together, however, U.S. Pat. No. 3,142,446 suggests that the lamp shade be more collapsible, so that it is necessary to assemble the shade into its original configuration before the lamp can be used, and the collapsible nature of the shade restricting the type of shades that may be packaged.

In general, the prior art proposals for packaging of lamps have had one or more of the following problems: Packaging of the shade and lamp in two different cartons. Providing a relatively large, bulky carton. Ease of damage to the product packaged. The necessity for utilization of different cartons, inner packs, cushioning materials, or the like for different styles of lamps. Excessive packaging time. Excessive packing material costs.

According to the present invention, it is believed that all of the above deficiencies have been overcome. In particular, a compact package is provided, one that is essentially no larger than the lamp and shade when in assembled condition, that is adaptable to a wide variety of lamp and shade styles, and positively prevents damage to either the lamp or shade packaged thereby. The time necessary for practicing the method of package assembly is small, and the material costs are low considering the degree of protection provided and the small size of the finished carton.

According to the present invention, an article containing carton is provided including a lamp, a lamp shade, and a carton having a horizontally extending bottom and top, and vertically extending sidewalls. The lamp includes a base and a pedestal, and the lamp shade is rigid including a supporting spider interior thereof. A heat shrinkable material fastens the lamp to a first support panel having cross-dimensions generally larger than the cross-dimensions of the lamp base, and the first support panel is operatively fastened to the carton bottom. Means are provided for mounting the lamp shade within the carton so that the lamp and the shade are always maintained in spaced relationship in the carton horizontal dimensions, and so that the lamp shade supporting spider and the lamp base are substantially always maintained in spaced relationship in the carton vertical dimension. The shade mounting means preferably comprises second and third support panels each having cross-dimensions of substantially the same size as the interior cross-dimensions of the carton, with a heat shrinkable material fastening the shade to the second and third support panels with the panels abutting opposite ends of the shades. Frictional engagement between the heat shrinkable material surrounding the second and third panels and the interior sidewalls of carton maintain the second and third panels, and the lamp shade mounted thereby, in a predetermined desired vertical position in the carton with both the second and third support panels spaced from the carton top and bottom. The third support panel has a central opening formed therein, and the second and third support panels and lamp shade are positioned within the carton so that a portion of the lamp base extends through the central opening in the third panel into the interior formed by the lamp shade, but spaced from the supporting spider. Preferably the lamp is provided with a detachable upper harp portion which is detached and packaged between the second support panel and the heat shrinkable material, and in this way it is possible to pack the lamp and shade in a configuration whereby they do not take up substantially anymore space than if they were assembled together, while still providing positive protection for the lamp and shade.

It is the primary object of the present invention to provide a low volume carton configuration that safely packs a lamp and shade in the same carton, and the method of assembly thereof. This and other objects of the invention will become clear from an inspection of the detailed description of the invention, and from the appended claims.

DETAILED DESCRIPTION OF THE INVENTION

Figure 1:
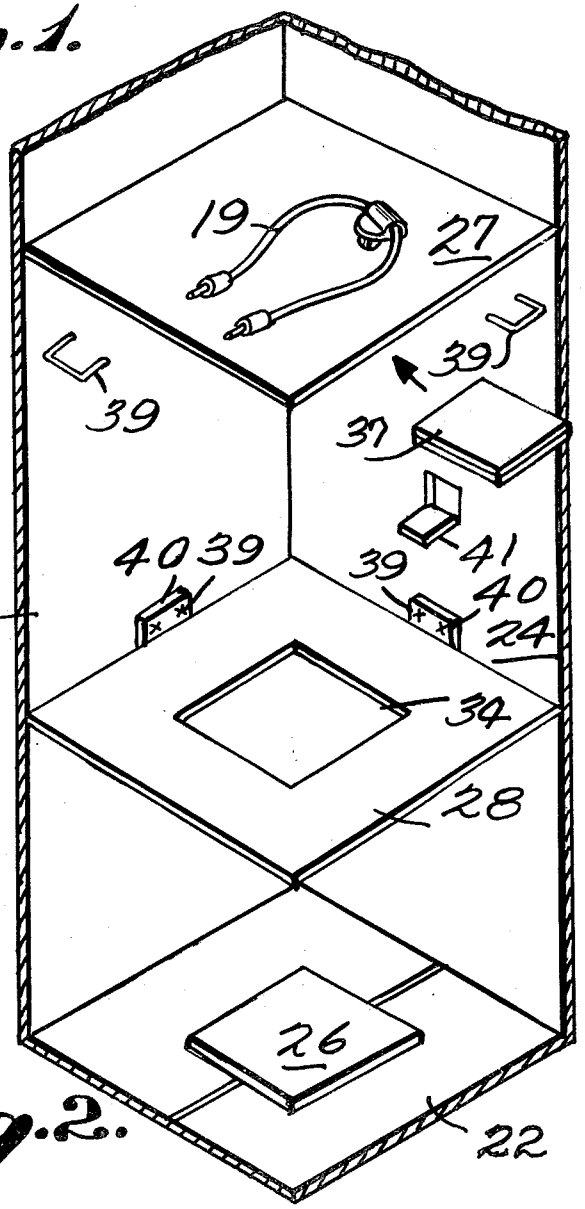
FIG. 1 is a side view, partly in section and partly in elevation, of an exemplary completed carton according to the present invention.

An article containing carton assembly according to the present invention is shown generally at 10 in FIG. 1. In describing the carton 10 the terms "vertical" and "horizontal" are utilized, however it is to be understood that these terms are merely relative and are utilized only for the clarity of description and are not limiting of the actual orientation of the carton 10 and its components.

The carton 10 includes a conventional lamp 12 of virtually any design, including a base 13 and a pedestal 14. A conventional lamp shade 15, also of virtually any design, including a conventional supporting spider 16, is also provided. Preferably the lamp 12 is of the type having a harp member lower portion 18 that is operatively attached to the pedestal 14 (i.e. at the socket 18') and a detachable upper harp position 19 (see FIG. 2 in particular) which in lamp use is attached to the lower harp portion 18 and operatively connected to the supporting spider 16. The detachable upper harp portion 19 is detached when packaged in the carton assembly 10.

The assembly 10 further comprises a carton 21 having a horizontally extending bottom 22 and top 23, and vertically extending sidewalls 24. The carton may be of substantially any shape and cross-section, such as circular or polygonal, but preferably—as shown in the drawings—is quadrate in cross-section, having four sidewalls 24. The carton is preferably formed of cardboard, having a closed bottom 22 and sidewalls 24 and the top 23 being open during assembly but closed once the final assembly 10 is formed.

In order to protect the lamp 12 and positively maintain it in position within the carton 21, a first support panel 26 (preferably of cardboard) is provided having cross-dimensions generally larger than the cross-dimensions of the lamp base 13, and heat shrinkable material 30 fastens the lamp 12 to the first support panel 26 in the manner illustrated in FIG. 1. The first support panel 26 is operatively fastened to the carton bottom 22, such as by adhesive means 31 (such as conventional hot melt adhesives). The heat shrinkable material 23 may be of any conventional type—such as a polyethylene bag—and may be utilized in any conventional manner for attaching the panel 26 and lamp 12 together, utilizing conventional machines. Typical equipment and materials that may be used for shrink-film packaging are disclosed in "Modern Packaging Encyclopedia and Planning Guide", 1972–1973, pages 98, 264 through 271, 288, 292, and 294B, the disclosure of which is hereby incorporated by reference in the present application.

Means are provided for mounting the lamp shade 15 within the carton 21 so that the lamp 12 and shade 15 are always maintained in spaced relationship in the carton horizontal dimensions, and so that the lamp shade supporting spider 16 and the lamp base 12 are substantially always maintained in spaced relationship in the carton vertical dimension. Such means preferably comprise the securement of the first panel 26 to the center of the bottom 22 of carton 21, and second and third supporting panels 27, 28, respectively, which also are preferably cardboard. The panels 27, 28, have substantially the same cross-dimensions as the interior of the carton 21, as shown in the drawings, and they are disposed on opposite ends of the shade 15 and fastened to the shade with heat shrinkable material 32 in the same manner that the heat shrinkable material 30 fastens the lamp 12 to the first panel 26. Normally frictional engagement between the heat shrinkable material 32 at the edges of the panels 27, 28, with the sidewalls 24 of the carton 21 maintains the panels 27, 28, and the shade 15 mounted thereby in a predetermined desired vertical position in the carton 21, with both the second and third panels 27, 28, spaced from the carton top and bottom 23, 22. Preferably, a small air cushion A is provided between the second panel 27 and the carton top 23.

In order to minimize carton space while still ensuring minimum possibility for damage, a central opening 34 is provided in the third panel 28, and the panels 27, 28, and lamp shade 15 supported thereby are vertically positioned along the sidewalls 24 so that a portion of the lamp 12 (i.e. the socket 18' and other portions of the pedestal 14 that normally would be interior of the shade 15) extends through the opening 34 into the volume defined by the shade 15, although still spaced from the supporting spider 16. Preferably, a portion 35 of the heat shrinkable material 32 provides a positive barrier between the lamp 12 and the supporting spider 16 so that even should the panels 27, 28, and lamp shade 15 mounted thereby move downward during transportation, the spider 16 would not engage the lamp 12.

Under some circumstances, especially where the supporting spider 16 is only a short distance from the top of the shade 15, padding means 37 are provided between the spider 16 and the bottom of the second support panel 27. As illustrated in the drawings, the padding means 37 takes the form of a plurality of cardboard squares. When the lamp 12 is the preferred type having a detachable upper harp portion 19, the harp portion 19 is disposed on top of the second panel 27 before wrapping with the heat shrinkable material 32, and thus the material 32 holds the harp portion 19 in place against the second panel 27. The second and third support panels 27, 28, have larger cross-dimensions than the lamp shade 15 so that the shade 15 is always positively maintained in spaced relationship not only from the lamp 12, but also from the sides 24 of the carton 21. The heat shrinkable material portion 35 also will positively prevent any horizontal movement of the shade 15 into engagement with the lamp 12, as will the normal forces of the heat shrinkable material 32 tending to pull the support panels 27, 28, together.

Figure 2:
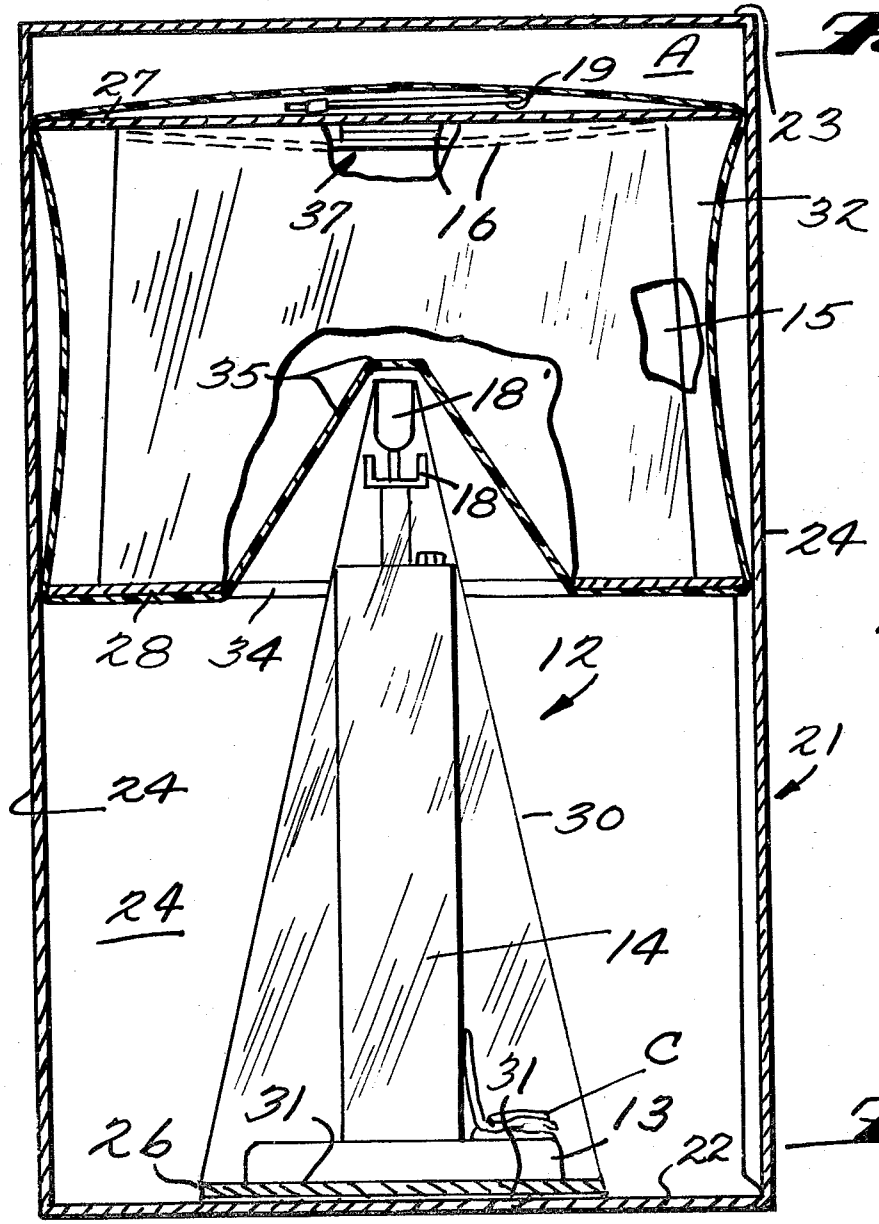
FIG. 2 is a perspective exploded view of the support panels of FIG. 1 with the carton top and some sidewalls cut away for clarity.

In those circumstances where the positioning of the support panels 27, 28, within the carton 21 is desired to be more positive than will normally be provided by frictional engagement, accessory structures may be utilized, such as fastening means 39 (shown as staples in FIG. 2). A tab 40 or the like may be formed on one or both of the panels 27, 28, and the tabs 40 fastened by the fasteners 39 to one or more sidewalls 24 of the carton 21, as shown in FIG. 2. Alternatively, or in addition, suitable supporting tab cutouts 41 may be formed in the sidewalls 24 for engaging the bottom of panel 28 or the top of panel 27 and maintaining it is position. (In FIG. 1 the tab 41 is positioned where it is for clarity, but it is of course understood that it would be below the panel 28 or above the panel 27 in actual use).

While a number of methods may be employed for packing the carton assembly 10 according to the invention, the preferred method for packing the lamp 12 and lamp shade 15 in the carton 21 is practiced with the bottom 22 and sides 24 of the carton substantially closed, with the top 23 originally open. The method comprises the steps of placing the lamp base 13 on the first support panel 26, with the cord C of the lamp 12 adjacent the base 13 and pedestal 14, fastening the lamp 12 and first support panel 26 together with the heat shrinkable material 30; disposing the second and third support panels 27, 28, on opposite sides of the lamp shade 15, in abutting engagement therewith, and fastening the lamp shade 15 and the second and third support panels 27, 28, together with the heat shrinkable material 32. Then, sequentially, inserting the heat shrinkable material wrapped lamp 12 and first support panel 26 into the carton interior, operatively affixing the first support panel 26 to the carton bottom 22 (such as by using hot melt adhesive), inserting the heat shrinkable material wrapped lamp shade 15 in second and third support panels 27, 28, into the carton interior and positioning them so that the heat shrinkable material 32 frictionally engages the interior sidewalls 24 of the carton 21 at the second and third panels 27, 28, with the second and third panels 27, 28, spaced from the carton top 23 and bottom 22; and then closing the carton top 23. The inserting and positioning steps preferably are practiced so that a portion of the lamp 12 extends through the central opening 34 and third support panel 28 into the interior volume defined by the lamp shade 15, but does not abut the supporting spider 16, which is rigidly attached to the shade 15. Also, the padding means 37 is preferably disposed between the supporting spider 16 and the bottom of panel 27, and the upper detachable harp portion 19 is disposed on top of the support panel 27 before fastening of the components 15, 27, and 28 together with the heat shrinkable material 32.

It will thus be seen that according to the present invention a carton assembly, and method of assembly thereof, have been provided which provide for positive separation of the lamp shade and lamp in both the horizontal and vertical dimensions at all times in a volume not substantially larger than the volume normally taken up by the assembled lamp shade and lamp, with minimum potential for damage to the lamp and lamp shade. This has been accomplished according to the invention in a manner that utilizes the same materials and basic design for a wide variety of lamp and lamp shade styles, utilizing relatively inexpensive materials, with a short packing time.

While the invention has been herein shown and described in what is presently conceived to be the most practical and preferred embodiment thereof, it will be apparent to those of ordinary skill in the art that many modifications may be made thereof within the scope of the invention, which scope is to be accorded the broadest interpretation of the appended claims so as to encompass all equivalent structures and methods.

We claim:

1. An article-containing carton comprising
a lamp, including a base and a pedestal,
a lamp shade, including a supporting spider interior thereof and attached thereto in normal supporting relationship,
a first support panel having cross-dimensions generally larger than the cross-dimensions of said lamp base,
a heat shrinkable material for fastening said lamp to said first support panel, with said lamp base resting on said support panel,
a carton having a horizontally extending bottom and top, and vertically extending sidewalls,
means for operatively fastening said first support panel to said carton bottom, and
means for mounting said lamp shade within said carton so that said lamp and said shade are always maintained in spaced relationship in the carton horizontal dimensions, and so that said lamp shade supporting spider and said lamp are substantially always maintained in spaced relationship in the carton vertical dimension.

2. A carton as recited in claim 1 wherein said shade mounting means comprising a second support panel and a third support panel, each of said support panels having cross-dimensions of substantially the same size as the interior cross-dimensions of said carton, and a heat shrinkable material fastening said shade to said second and third support panels with said panels abutting opposite ends of said shade.

3. A carton as recited in claim 2 wherein said means for fastening said first support panel to said carton bottom fastens said support panel so that said lamp is located substantially in the center of said bottom, and wherein said shade mounting means further comprises a central opening in said third support panel concentric with said lamp, and wherein said shade mounting means comprises means for mounting said shade so that the portion of said lamp closest to said carton top extends through said third panel opening into the interior volume defined by said shade, but terminating short of said supporting spider.

4. A carton as recited in claims 2 or 3 wherein said shade mounting means further comprises frictional engagement between the heat shrinkable material surrounding said second and third panels and the interior sidewalls of said carton maintaining said second and third support panels, and said lamp shade mounted thereby, in a predetermined desired vertical position in said carton, with both said second and third support panels spaced from said carton top and bottom.

5. A carton as recited in claim 2 further comprising fastening means for fastening at least one of said second and third support panels to said carton sidewalls.

6. A carton as recited in claim 2 wherein the heat shrinkable material fastening said lamp shade to said second and third support panels provides a substantially positive barrier between said lamp and said supporting spider.

7. An article-containing carton comprising
a lamp, including a base and a pedestal;
a lamp shade, including a supporting spider interior thereof and attached thereto in normal supporting relationship;
a first support panel having cross-dimensions generally larger than the cross-dimensions of said lamp base;
means for fastening said lamp to said first support panel, with said lamp base resting on said support panel;
a carton having a horizontally extending bottom and top, and vertically extending sidewalls;
means for operatively fastening said first support panel to said carton bottom; and
means for mounting said lamp shade within said carton so that said lamp and said shade are always maintained in spaced relationship in the carton horizontal dimensions, and so that said lamp shade supporting spider and said lamp are substantially always maintained in spaced relationship in the carton vertical dimension, said shade mounting means comprising a second support panel and a third support panel, each of said support panels having cross-dimensions of substantially the same size as the interior cross-dimensions of said carton and means for mounting shade with said second and third support panels with said panels abutting opposite ends of said shade.

8. A carton as recited in claim 7 further comprising padding means operatively disposed between said supporting spider and at least one of said second and third support panels.

9. A carton as recited in claim 7 wherein said lamp further includes a lower harp portion operatively affixed to said lamp pedestal, and an upper harp portion detachable from said lower harp portion, said upper harp portion being detached from said lower harp portion and disposed between one of said second and third support panels and the heat shrinkable material surrounding same.

10. A carton as recited in claim 7 wherein said first support panel has cross-dimensions substantially less than the cross-dimensions of said carton, and wherein said means for operatively fastening said first support panel to said carton bottom comprises adhesive means.

11. A carton as recited in claim 7 wherein said means for fastening said first support panel to said carton bottom fastens said support panel so that said lamp is located substantially in the center of said bottom, and wherein said shade mounting means further comprises a central opening in said third support panel concentric with said lamp, and wherein said shade mounting means comprises means for mounting said shade so that the portion of said lamp closest to said carton top extends through said third panel opening into the interior volume defined by said shade, but terminating short of said supporting spider.

12. A carton assembly comprising a carton having a horizontally extending bottom and top, and vertically extending sidewalls, a lamp including a base and pedestal, a first support panel having cross-dimensions generally larger than the cross-dimensions of said lamp base, a heat shrinkable material for fastening said lamp to said first support panel, with said lamp base resting on said support panel, means for operatively fastening said first support panel to the center of said carton bottom, a lamp shade, including a supporting spider interior thereof, and rigidly attached thereof, a second support panel having cross-dimensions of substantially the same size as the interior cross-dimensions of said carton, a third support panel having cross-dimensions of substantially the same size as the interior cross-dimensions of said carton, and having a central opening formed therein, a heat shrinkable material fastening said shade to said second and third support panels with said panels abutting opposite ends of said shade, and means for mounting said shade with second and third support panels in said carton so that said second and third support panels are both spaced from said carton top and bottom, and so that a portion of said lamp extends through the opening in said third support panel into the interior volume defined by said shade but spaced from said supporting spider.

13. An article-containing carton comprising a lamp, including a base and a pedestal;

a lamp shade, including a supporting spider interior thereof and attached thereto in normal supporting relationship;

a carton having a horizontally extending bottom and top, and vertically extending sidewalls;

a first support panel having cross-dimensions generally larger than the cross-dimensions of said lamp base, and substantially less than cross-dimensions of said carton;

a heat shrinkable material for fastening said lamp to said first support panel, with said lamp base resting on said support panel;

adhesive means for operatively fastening said first support panel to said carton bottom; and means for mounting said lamp shade within said carton so that said lamp and said shade are always maintained in spaced relationship in the carton horizontal dimensions, and so that said lamp shade supporting spider and said lamp are substantially always maintained in spaced relationship in the carton vertical dimension.

* * * * *